US007469515B2

(12) United States Patent
Minor

(10) Patent No.: US 7,469,515 B2
(45) Date of Patent: Dec. 30, 2008

(54) CONCRETE REINFORCING BAR CLIP

(76) Inventor: Jack M. Minor, 1155 Achilles Cir., Lafayette, CO (US) 80026

( * ) Notice: Subject to any disclaimer, the term of this patent is extended or adjusted under 35 U.S.C. 154(b) by 581 days.

(21) Appl. No.: 11/192,568

(22) Filed: Jul. 29, 2005

(65) Prior Publication Data

US 2006/0059850 A1 Mar. 23, 2006

Related U.S. Application Data

(60) Provisional application No. 60/598,157, filed on Aug. 2, 2004.

(51) Int. Cl.
*E04C 5/20* (2006.01)
*F16B 7/04* (2006.01)

(52) U.S. Cl. ..... 52/719; 403/397; 403/400

(58) Field of Classification Search ..... 24/563, 24/570, 545, 129 R, 129 B, 130; 52/719, 52/686, 687; 403/385, 400, 394, 395, 396, 403/397, 399

See application file for complete search history.

(56) References Cited

U.S. PATENT DOCUMENTS

| | | | | | |
|---|---|---|---|---|---|
| 673,557 | A | * | 5/1901 | Hooker | 403/400 |
| 878,949 | A | * | 2/1908 | Hanson | 24/129 R |
| 1,070,921 | A | * | 8/1913 | Saltiel | 52/686 |
| 2,520,998 | A | * | 9/1950 | Cella | 403/400 |
| 3,004,370 | A | * | 10/1961 | Tinnerman | 52/719 |
| 3,017,205 | A | * | 1/1962 | Williams | 403/397 |
| 3,145,260 | A | * | 8/1964 | Reid et al. | 403/397 |
| D201,387 | S | | 6/1965 | Reeves | |
| 3,591,215 | A | * | 7/1971 | Frost et al. | 403/396 |
| 3,673,753 | A | | 7/1972 | Anderson | |
| 3,788,025 | A | | 1/1974 | Holmes | |
| 4,110,951 | A | * | 9/1978 | Padrun | 52/686 |
| 4,309,120 | A | * | 1/1982 | Werthmann | 403/397 |
| D281,952 | S | | 12/1985 | Farmer et al. | |
| 4,575,985 | A | | 3/1986 | Eckenrodt | |
| 4,598,523 | A | | 7/1986 | Tolliver | |

(Continued)

FOREIGN PATENT DOCUMENTS

| | | |
|---|---|---|
| DE | 823 648 | 12/1951 |

(Continued)

OTHER PUBLICATIONS

Jack M. Minor, et al., U.S. Appl. No. 29/211,496, filed Aug. 17, 2004, filing receipt, application and drawings attached hereto.

(Continued)

*Primary Examiner*—Michael Safavi
(74) *Attorney, Agent, or Firm*—Margaret Polson; Patent Law Offices of Rick Martin, PC

(57) ABSTRACT

A concrete reinforcing bar clip has a pair of arms oriented at an angle of approximately 90°. Each arm has a clamp mounted at each of its ends, thus allowing a worker to push in one direction to attach all four clamps onto two crossed concrete reinforcing bars. The length of the arms adds some stability to the temporary intersection of the concrete reinforcing bars before the concrete is poured. The concrete reinforcing bars may have physical contact in the clamp, also adding to the stability of the joint. One embodiment uses a single tube as one arm.

7 Claims, 11 Drawing Sheets

U.S. PATENT DOCUMENTS

| | | | | |
|---|---|---|---|---|
| 4,610,122 | A | 9/1986 | De Clereq | |
| D301,333 | S | 5/1989 | Bongard et al. | |
| 4,835,933 | A | 6/1989 | Yung | |
| 5,323,582 | A | 6/1994 | Watson | |
| 5,358,423 | A * | 10/1994 | Burkhard et al. | 403/394 |
| 5,371,991 | A | 12/1994 | Bechtel et al. | |
| D355,582 | S | 2/1995 | Sleight | D8/354 |
| D371,861 | S | 7/1996 | Stamm | |
| 5,688,428 | A | 11/1997 | Maguire | |
| 5,730,432 | A | 3/1998 | Gendreau et al. | |
| 5,752,860 | A | 5/1998 | Greaves | |
| 5,878,546 | A | 3/1999 | Westover | |
| 5,893,252 | A | 4/1999 | Hardy, Jr. et al. | |
| D414,680 | S | 10/1999 | Mathews | |
| 6,009,680 | A * | 1/2000 | Mathews | 52/719 |
| 6,017,014 | A | 1/2000 | Maguire | |
| 6,112,494 | A | 9/2000 | Hardy, Jr. et al. | |
| 6,276,108 | B1 | 8/2001 | Padrun | |
| 6,385,938 | B1 | 5/2002 | Gavin | |
| 6,684,594 | B1 | 2/2004 | Sorkin | |
| 6,684,595 | B1 | 2/2004 | Sorkin | |
| 2003/0000170 | A1 | 1/2003 | Sorkin | |
| 2003/0197108 | A1 | 10/2003 | Domizio | |
| 2004/0031228 | A1 | 2/2004 | Hardy, Jr. et al. | |
| 2004/0040247 | A1 | 3/2004 | Morse | |

FOREIGN PATENT DOCUMENTS

| | | |
|---|---|---|
| FR | 2.151.236 | 4/1973 |
| GB | 1142886 | 2/1969 |
| GB | 1250021 | 10/1971 |

OTHER PUBLICATIONS

Jack M. Minor, et al., U.S. Appl. No. 29/231,625, filed Jun. 8, 2005, filing receipt, application and drawings attached hereto.

Brent W. Murray, U.S. Appl. No. 29/231,626, filed Jun. 8, 2005, filing receipt, application and drawings attached hereto.

Jack M. Minor et al., U.S. Appl. No. 29/231,770, filed Jun. 9, 2005, filing receipt, application and drawings attached hereto.

Written Opinion of International Search Report—mailed Feb. 15, 2007 Application No. PCT/US2005/027166 Dated: Jul. 29, 2005 Applicant: Jack M. Minor Corresponding PCT Application.

One (1) page printed from "http://www.brc.ltd.uk/spacers/index.htm", printed Dec. 19, 2005; unknown publication date.

One (1) page printed from "http://www.seifert.de/products/prod5.htm", printed Dec. 19, 2005; unknown publication date.

Two (2) pages printed from "http://www.seifert.de/products/prod6.htm", printed Dec. 19, 2005; unknown publication date.

Two (2) pages printed from "http://www.seifert.de/products/prod7.htm", printed Dec. 19, 2005; unknown publication date.

International Search Report dated Dec. 23, 2005 for International Application No. PCT/US2005/027166.

Written Opinion of the International Searching Authority dated Dec. 23, 2005 for International Application No. PCT/US2005/027166.

* cited by examiner

Fig. 1
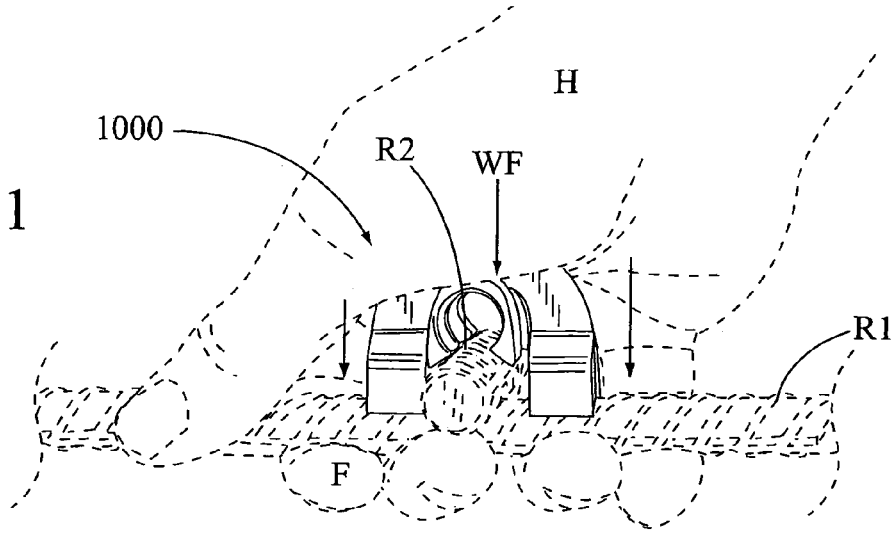
Fig. 2
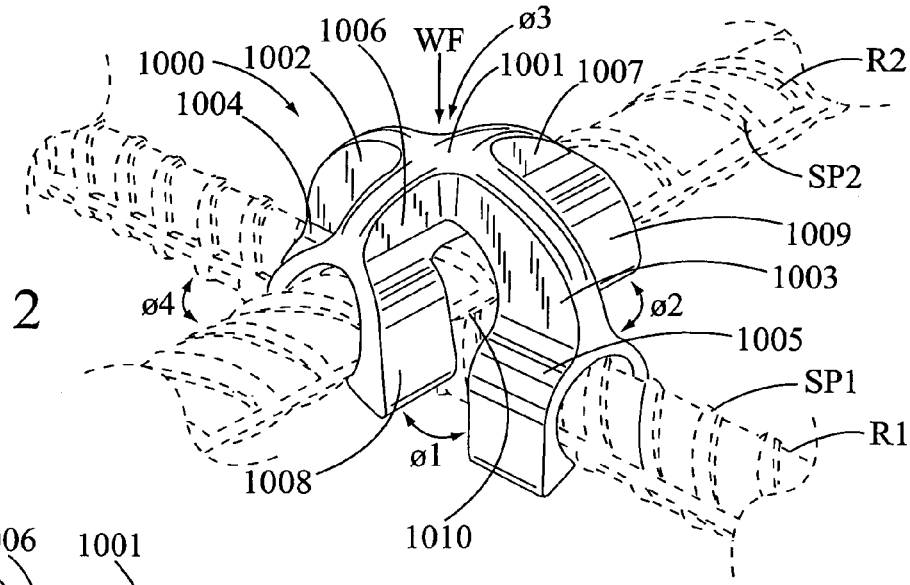
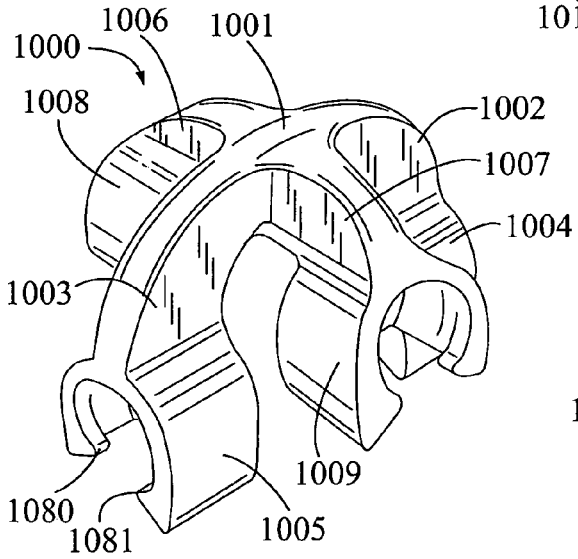
Fig. 3
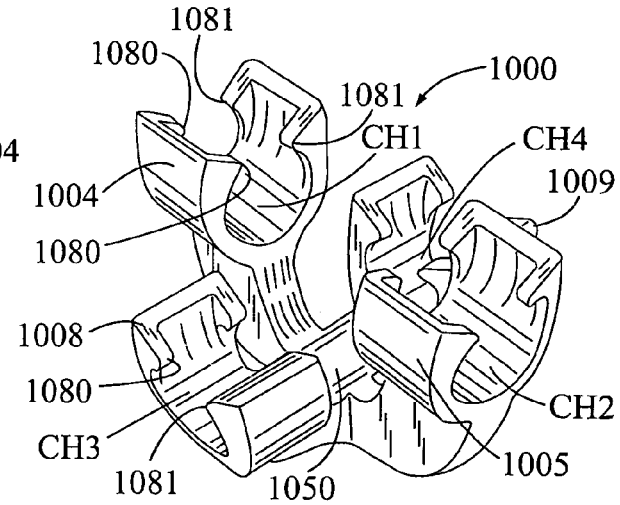
Fig. 4

Fig. 25
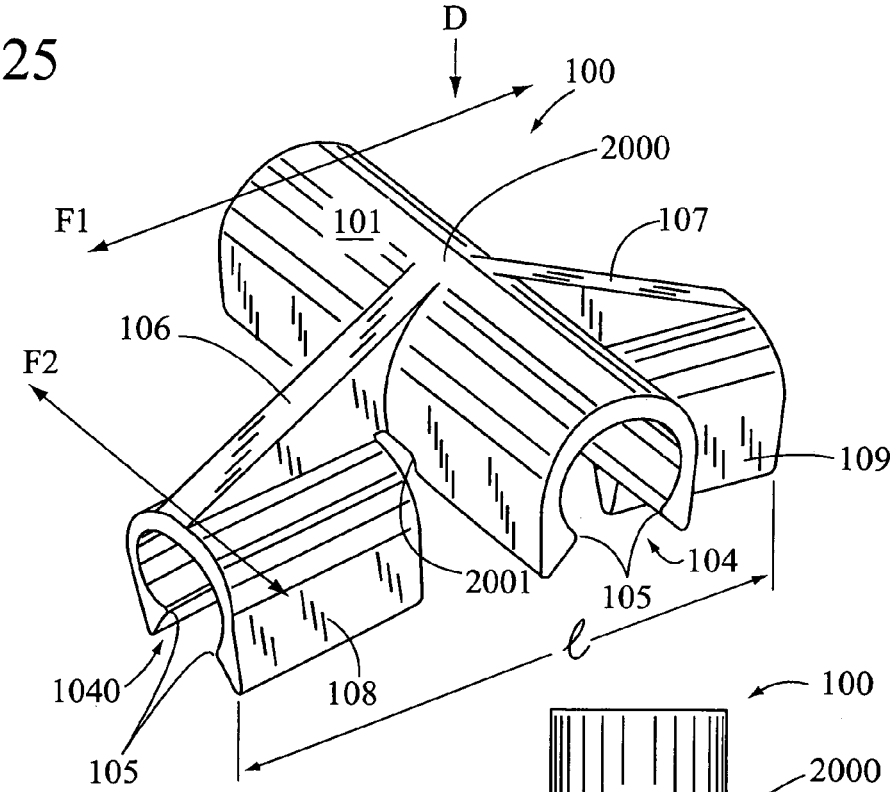
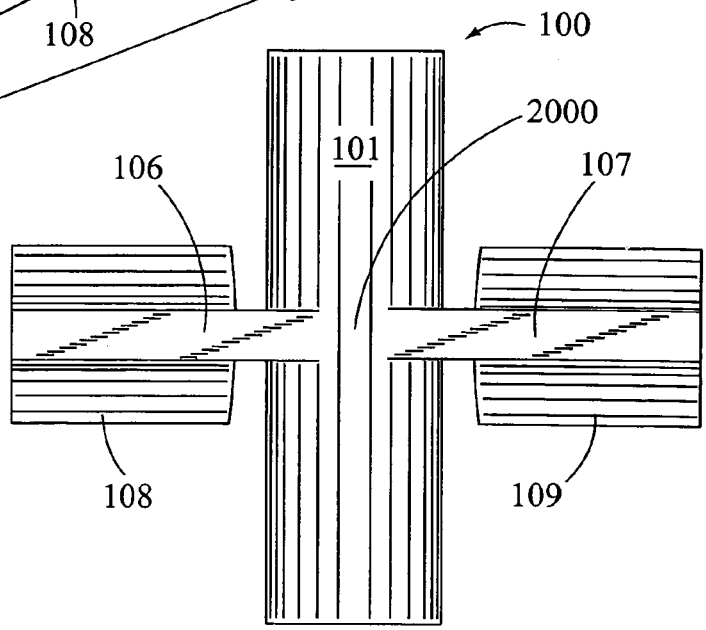
Fig. 27
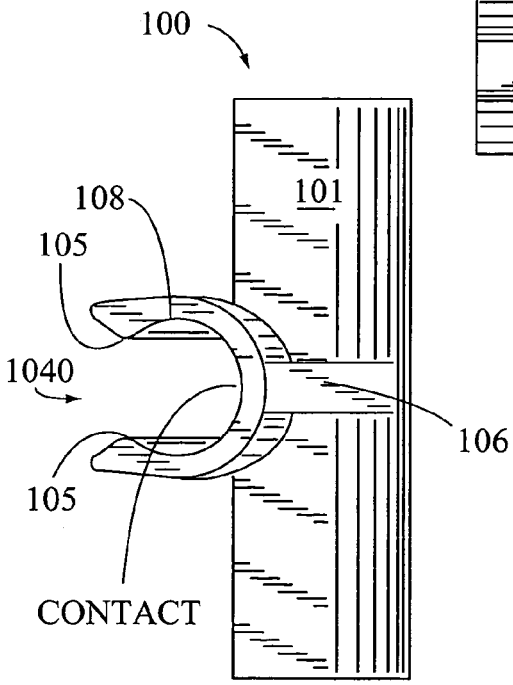
Fig. 26

CONCRETE REINFORCING BAR CLIP

CROSS REFERENCE APPLICATIONS

This application is a non-provisional application claiming the benefits of provisional application No. 60/598,157 filed Aug. 2, 2004.

BACKGROUND

Historically concrete reinforcing bar ("re-bar") rods have been hand wired or tied together at their intersecting points for temporary support before concrete is poured over the re-bar matrix. The hand wiring or tying of the re-bar rods is a costly time consuming task. Various clamps have been invented to eliminate the hand-wiring step.

The prior art does not disclose a re-bar clip that mounts into the intersection in substantially one motion while providing lateral stability to the temporary grid established by crossed re-bars.

SUMMARY

The present apparatus provides a one piece clip that attaches onto a pair of crossed re-bars from one direction in a single motion.

The disclosed apparatus also provides a re-bar clamp having a pair of arms of sufficient length to add stability to resist a deformation from about a 90° orientation of a pair of crossed re-bars.

These and other features and advantages of the re-bar clip reside in the construction of parts and the combination thereof, the mode of operation and use, as will become more apparent from the following description, reference being made to the accompanying drawings that form a part of this specification wherein like reference characters designate corresponding parts in the several views. The embodiments and features thereof are described and illustrated in conjunction with systems, tools and methods which are meant to exemplify and to illustrate, not being limiting in scope.

An embodiment consists of a pre-molded one-piece plastic clamp. Two identical arms are co-joined at about a 90° angle. Each arm has two opposing ends. Each end has a clamp integrated into it, wherein all open segments of the clamps face in the same direction. In operation, a worker can prepare the crossed re-bars in a traditional manner. When a pair of re-bars need fastening together, the clip is pressed against the intersection in one motion, thereby locking four clamps onto two re-bars.

BRIEF DESCRIPTION OF THE DRAWINGS

FIG. 1 is a side perspective view of an embodiment of a re-bar clip being pressed into connection with a pair of crossed re-bars.

FIG. 2 is a top perspective view of the re-bar clip of FIG. 1 connecting the two re-bars.

FIG. 3 is a top perspective view of the re-bar clip of FIG. 1 without the re-bars.

FIG. 4 is a bottom perspective view of the re-bar clip of FIGS. 1-3.

FIG. 25 is a top plan view of yet another embodiment of a re-bar clip.

FIG. 26 is a side plan view of the FIG. 25 re-bar clip.

FIG. 27 is a top plan view of the FIG. 25 re-bar clip.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Referring to FIGS. 1-10, a clip 1000 is shown. Clip 1000 comprises clamps 1004, 1005, 1008, and 1009 positionable at angles $\phi_1$, $\phi_2$, $\phi_3$, $\phi_4$, one from another. Depending on design specifications the angle can be $\phi=\phi_1=\phi_2=\phi_3=\phi_4$ or $\phi\neq\phi_1\neq\phi_2\neq\phi_3\neq\phi_4$. As shown in FIG. 2, $\phi_1$ through $\phi_4$ are about 90°. Clamps 1004, 1005, 1008 and 1009 comprise openings that are extendable at least one re-bar width.

Arms 1002, 1003 support clamps 1004, 1005 so as to clip or attach to re-bar R1. Arms 1006, 1007 support clamps 1008, 1009 so as to clip or attach to re-bar R2 at a crossed orientation of about 90° relative to re-bar R1. Clamps 1004, 1005 are disposed about the width of the re-bar below clamps 1008, 1009. The central area 1001 joins arms 1002, 1003, 1006, 1007 and may provide an area, comfortably fitting the worker's hand H in the palm area while the worker's finger's F may grasp around the crossed re-bars R1, R2. A worker's force WF is provided by hand H, thereby clipping clip 1000 to re-bars R1, R2 as shown in FIG. 2. The re-bars may touch at point 1010, depending on the orientation of the ridges SP1, SP2. Each clamp may have two pair of engagement flanges 1080, 1081, one pair at each end of the clamp. These flanges often settle between ridges SP1, SP2 of re-bars R1, R2. However, they may also rest atop ridges SP1, SP2.

Worker's force WF can be exerted in any direction depending on the application of the re-bar and/or device used. In addition, the number and position of flanges will depend on the size of re-bar to be clamped and the application the device is to be used in. Such design constructions are well-known in the art.

Clamps 1004, 1005 may form a re-bar channel via enclosures CH1, CH2, also called a concrete reinforcing bar support surface. Clamps 1008, 1009 may form a re-bar center channel 1050 via enclosures CH3, CH4. Enclosures CH1, CH2 are distal from center channel 1050 by about a re-bar width. Center channel 1050 may add support to the re-bar.

Figure 5:
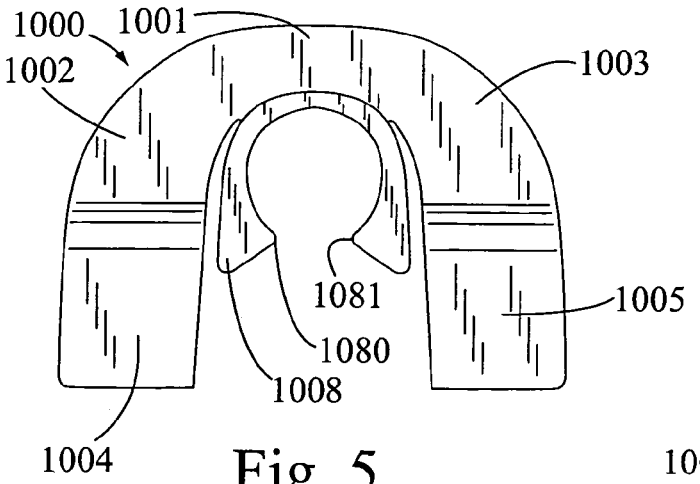
FIG. 5 is a side plan view of the re-bar clip of FIGS. 1-4.
Figure 6:
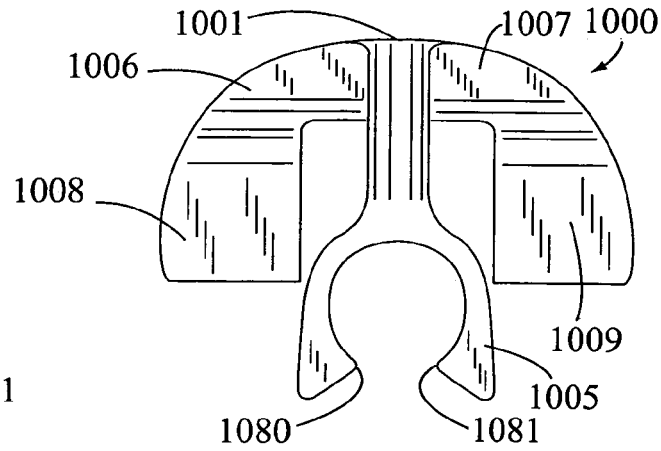
FIG. 6 is an adjacent side plan view of the re-bar clip of FIG. 5.
Figure 7:
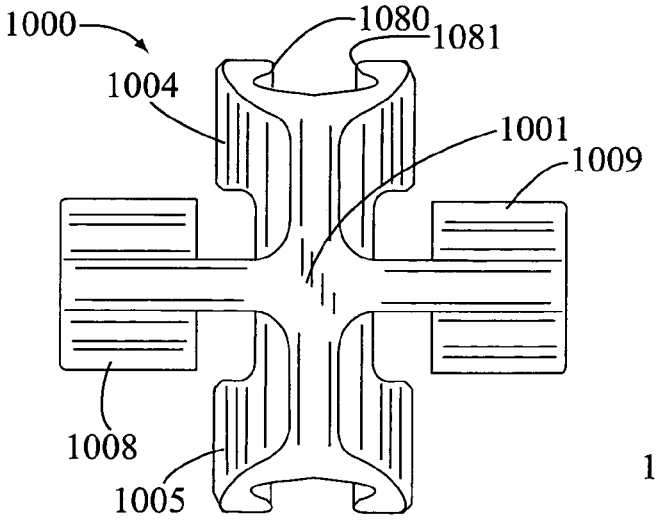
FIG. 7 is a top plan view of the re-bar clip of FIGS. 1-6.
Figure 8:
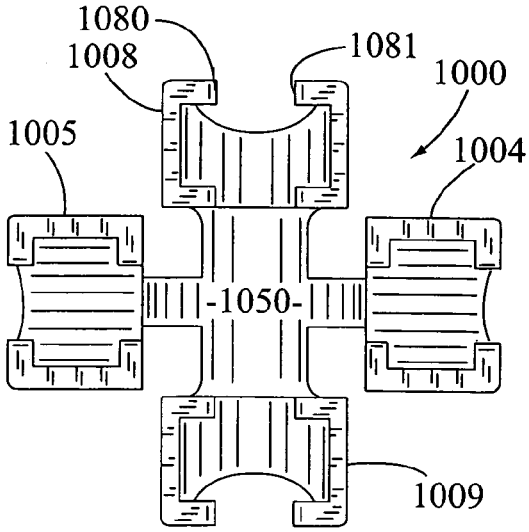
FIG. 8 is a bottom plan view of the re-bar clip of FIGS. 1-7.
Figure 9:
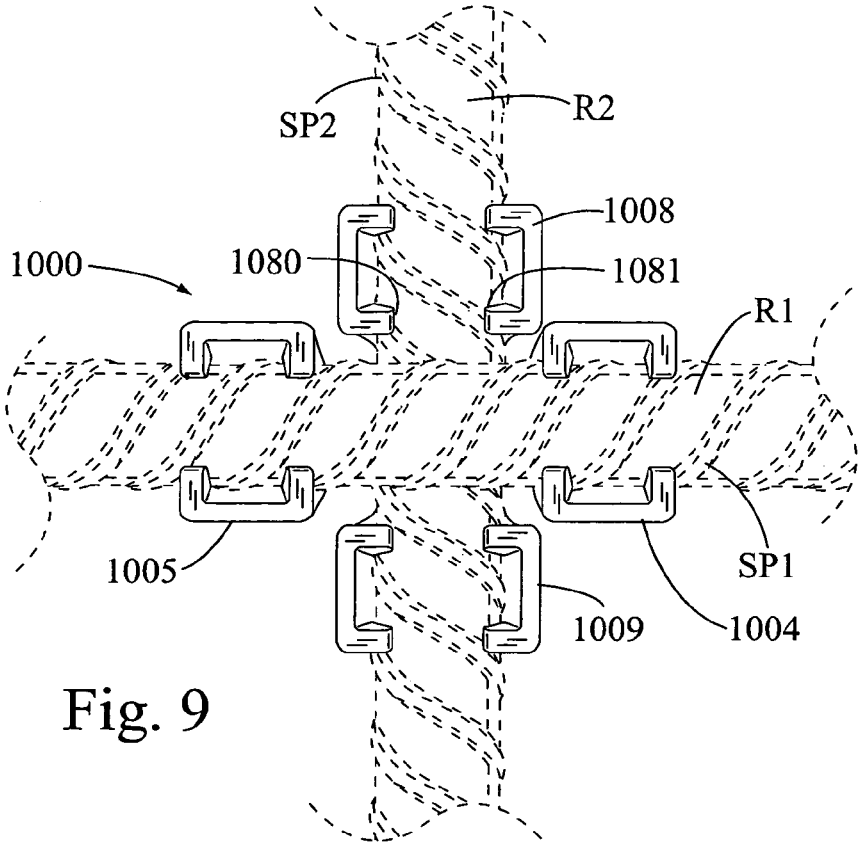
FIG. 9 is a bottom plan view of the re-bar clip of FIGS. 1-7 as with re-bars illustrated in broken lines.
Figure 10:
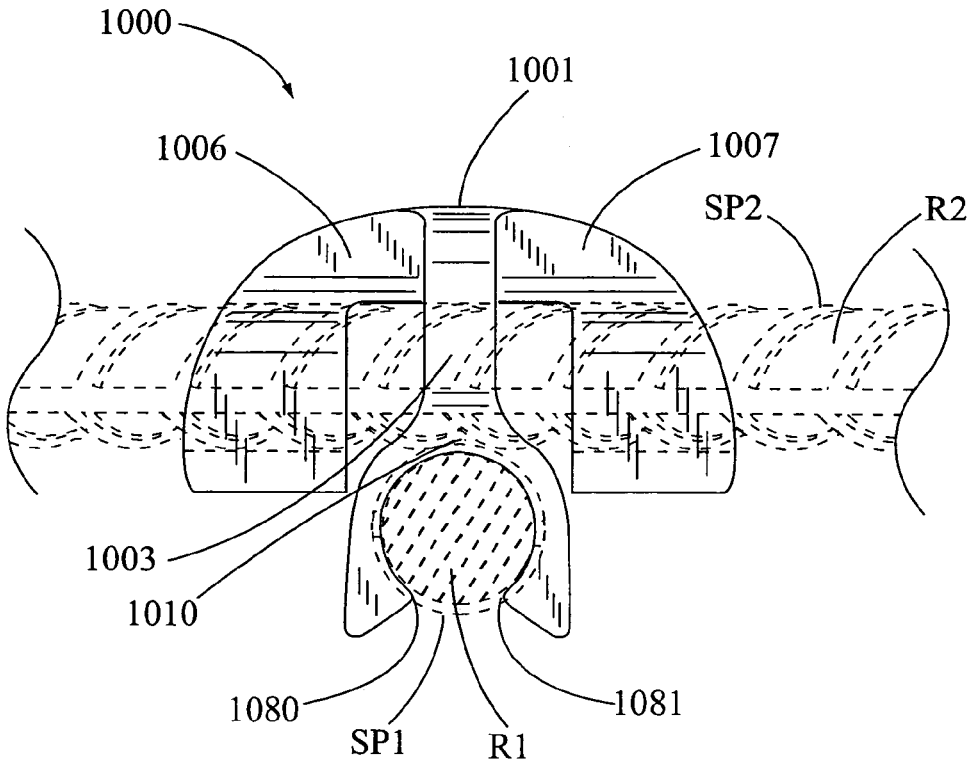
FIG. 10 is an adjacent plan view of the re-bar clip of FIG. 5 with re-bars illustrated in broken lines.
Figure 11:
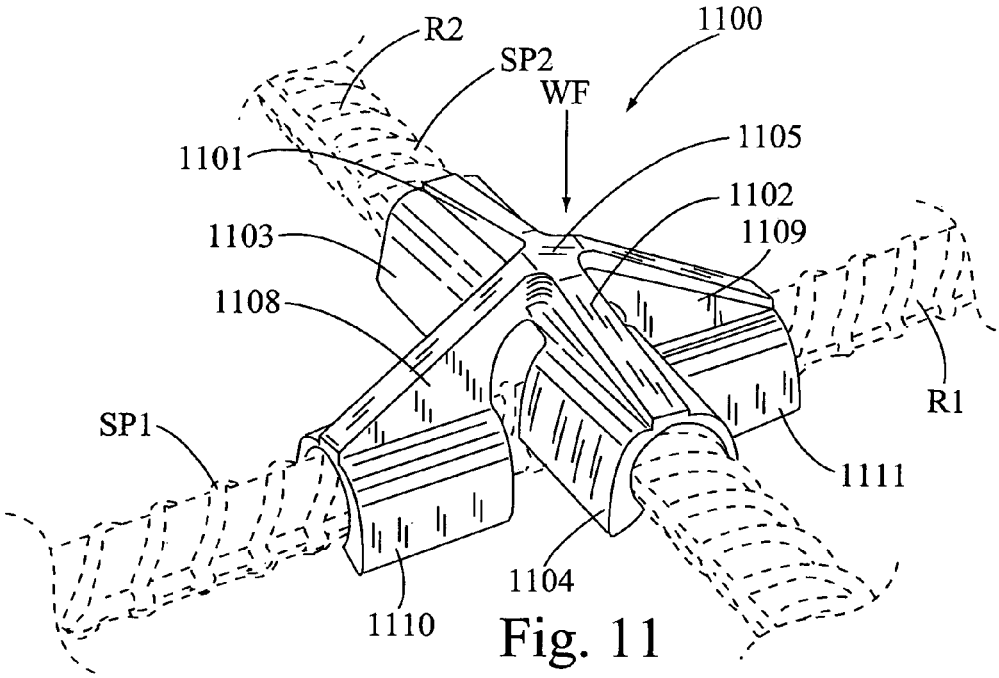
FIG. 11 is a top perspective view of another embodiment of a re-bar clip.
Figure 12:
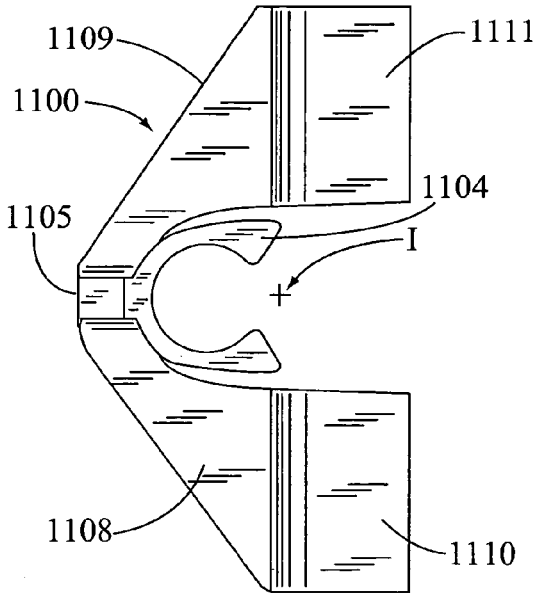
FIG. 12 is a side plan view of the FIG. 11 re-bar clip.
Figure 13:
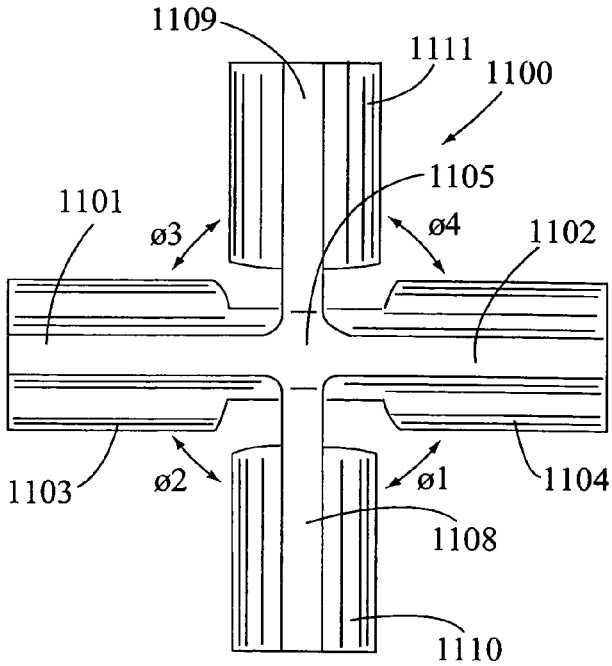
FIG. 13 is a top plan view of the FIG. 11 re-bar clip.
Figure 14:
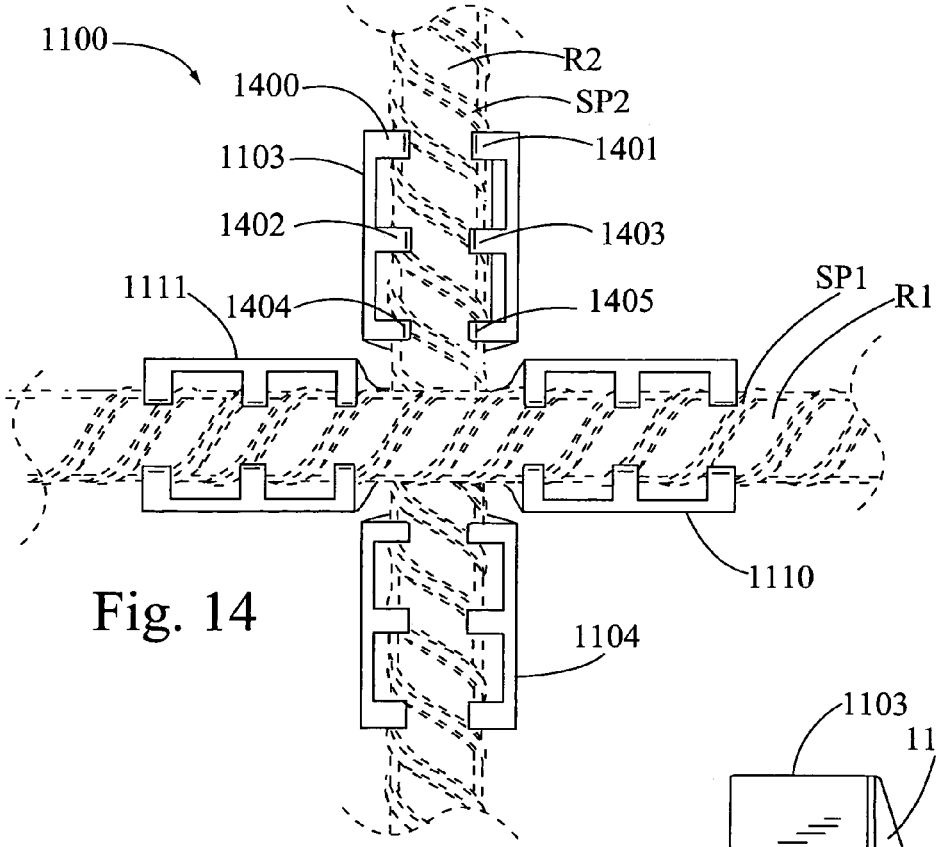
FIG. 14 is a bottom plan view of the FIG. 11 re-bar clip with the connected re-bar shown in broken lines.
Figure 15:
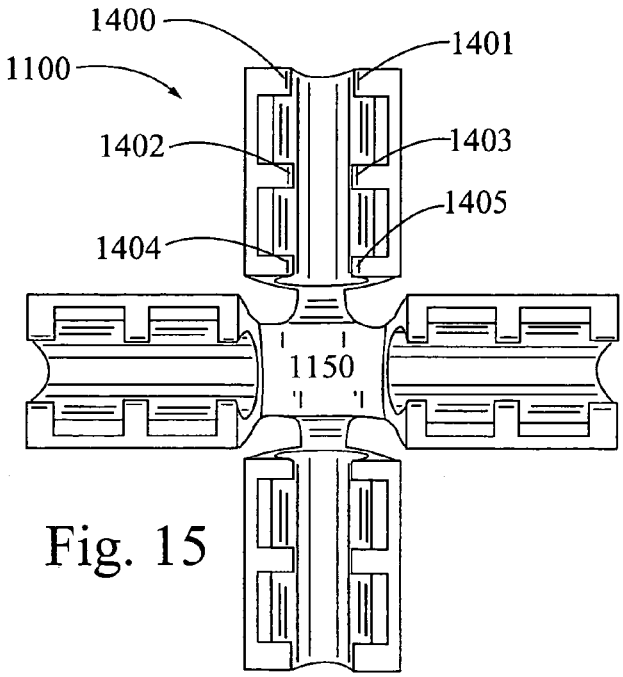
FIG. 15 is a bottom plan view of the FIG. 11 re-bar clip without the re-bars.
Figure 16:
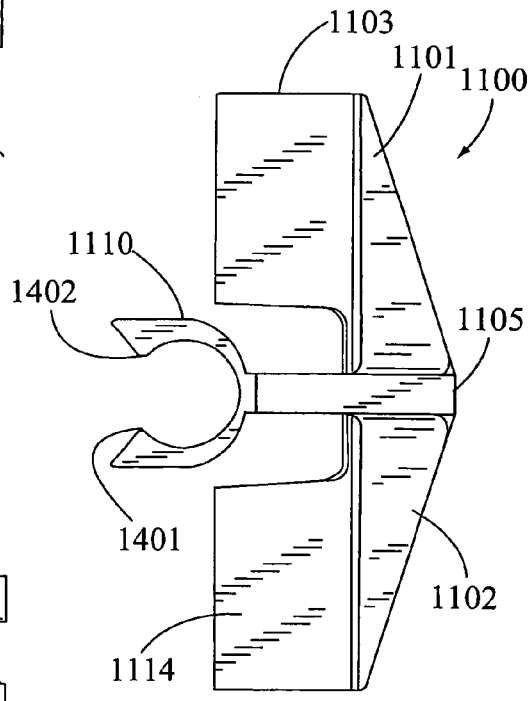
FIG. 16 is an adjacent side plan view of the re-bar clip shown in FIG. 12.
Figure 17:
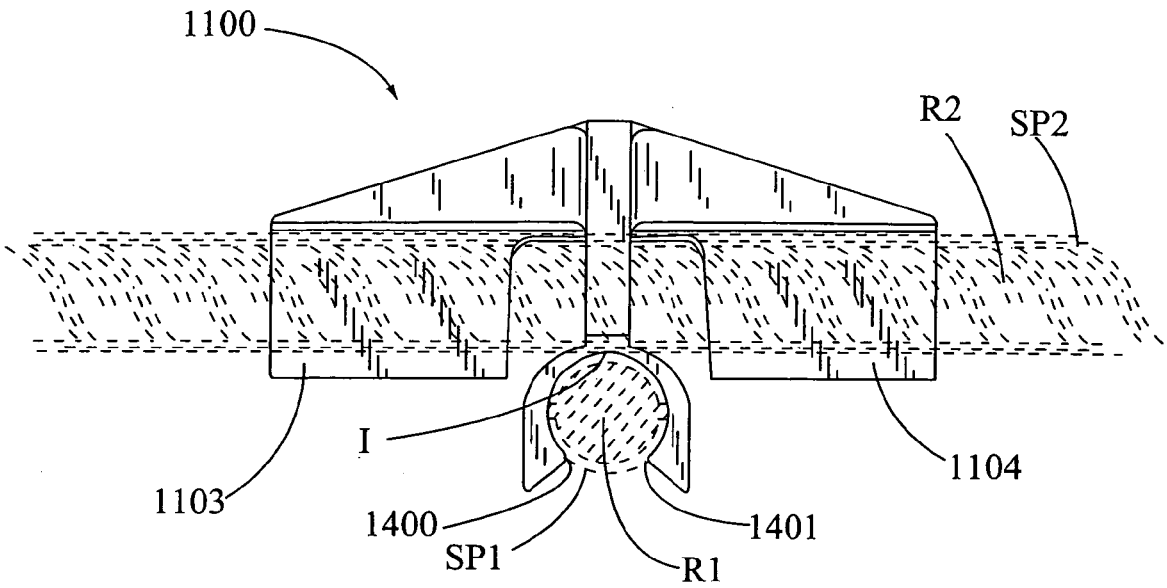
FIG. 17 is a side view of the FIG. 16 re-bar clip illustrating connected re-bars in broken lines.
Figure 18:
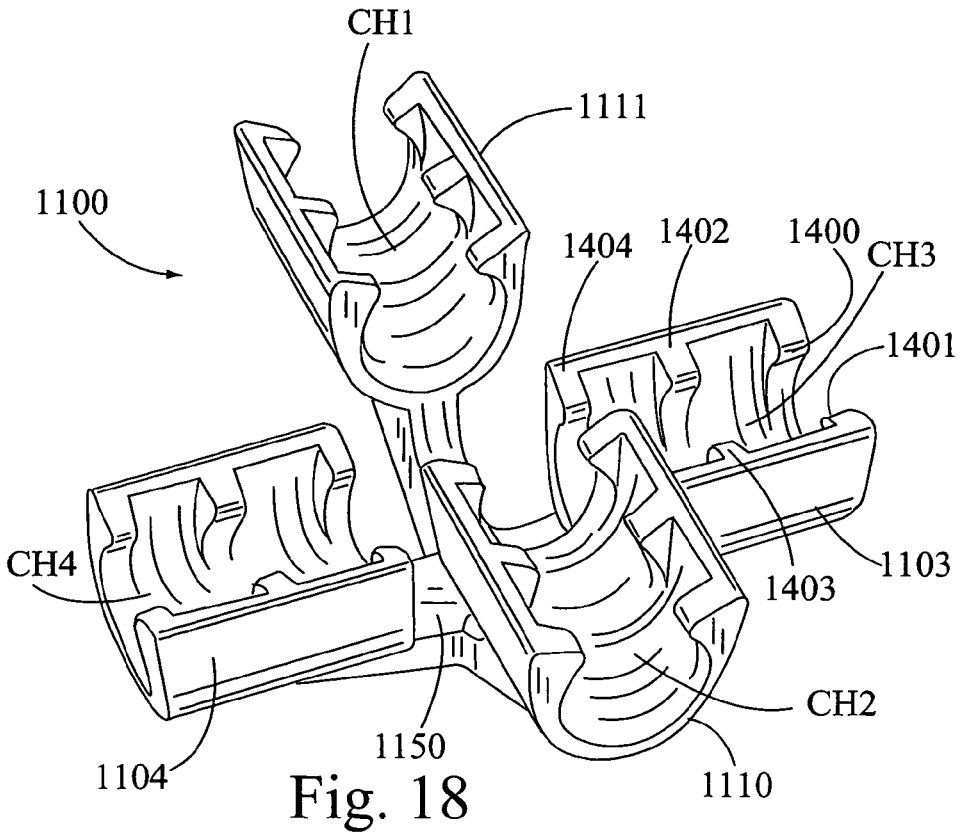
FIG. 18 is a bottom perspective view of the re-bar clip of FIGS. 11-17.

Referring next to FIGS. 11-18 re-bar clip 1100 is shown. Clip 1100 comprises clamps 1103, 1104, 1110, and 1111 positionable at angles $\phi_1$, $\phi_2$, $\phi_3$, $\phi_4$, one from another. Depending on design specifications the angle can be $\phi=\phi_1, \phi_2, \phi_3, \phi_4$, or $\phi\neq\phi_1\neq\phi_2\neq\phi_3\neq\phi_4$. As shown in FIG. 13, $\phi_1$ through $\phi_4$ are about 90°. Clamps 1103, 1104, 1110, and 1111 comprise openings that are extendable at least one re-bar width.

Arms 1101, 1102 support clamps 1103, 1104. A worker's force WF pushes on central body 1105 to clip or attach re-bar R2 into clamps 1103, 1104. The same force WF clips or attaches re-bar R1 into clamps 1110, 1111 which are supported by arms 1108, 1109. All arms are joined at central body 1105. C clamps 1110, 1111 are at about a 90° orientation to arms 1103, 1104.

FIG. 12 illustrates how clamps 1110, 1111 are mounted about one re-bar width from the central body 1105 to allow a pair of crossed re-bars to touch and/or nearly touch at intersection I.

FIG. 13 illustrates central body 1105 configured to be to be comfortable for worker's palm to exert force WF.

FIGS. 14-18 illustrate clamps having three sets of flanges 1400/1401, 1402/1403, 1404/1405. Some flanges fit between ridges SP1, SP2 and some flanges rest atop ridges SP1, SP2. As indicated above, the number of flanges may vary depending on the application.

Clamps 1110, 1111 may form a re-bar channel via enclosures CH1, CH2. Clamps 1103, 1104 may form a re-bar center channel 1150 via enclosures CH3, CH4. Enclosures CH1, CH2 are distal from center channel 1150 by about a re-bar width. Center channel 1150 may add support to the re-bar.

As with all embodiments, the worker only has to align clamps 1103, 1104 with the upper most re-bar and attach the clip into connection with the crossed re-bars.

Referring next to FIGS. 19-24 a clip 1 has a center 2 from which emanates a first arm 3 and a second arm 4, wherein the arms are set at about a 90° angle relative to one another. Each arm has a pair of approximately parallel structural walls M1, M2, M11, M12. The plane P1 formed by the base of arm 3 is adjacent the center 2, wherein the plane P2 formed by the base of arm 4 is about the width of one re-bar (R1 or R2) from center 2. The four clamps C may be similar, one attached to each arm end 30, 31, 40, 41, and may be constructed out of a resilient material such as polypropylene. The four clamps C contain comprise openings that are extendable at least one re-bar width.

When clip 1 is affixed to re-bars R1, R2 as shown, the re-bars may physically contact one another as shown by CONTACT. This contact may help reinforce the temporary stability of the re-bar intersection before concrete is poured over the whole assembly. The ridges SP1, SP2 may be oriented such that they do not touch. However, they may also be close together.

Figure 19:
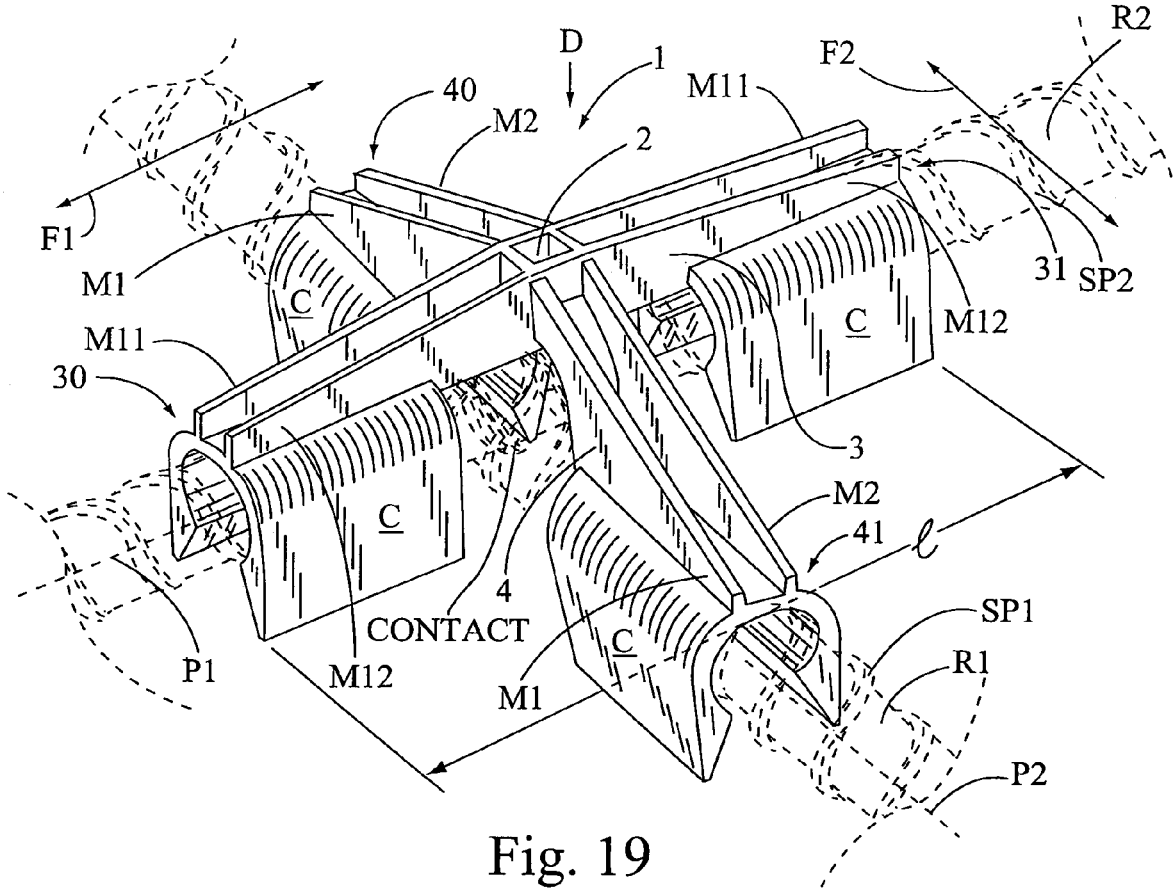
FIG. 19 is a top perspective view of another embodiment of a re-bar clip.
Figure 20:
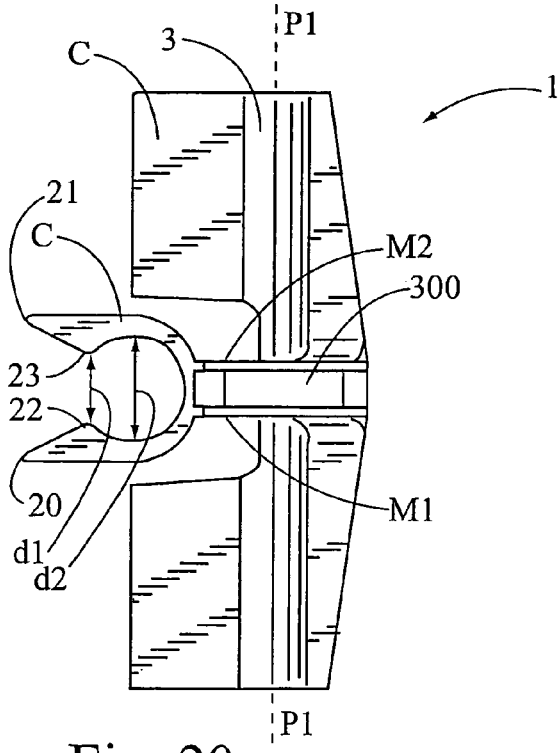
FIG. 20 is a side plan view of the FIG. 19 re-bar clip.
Figure 21:
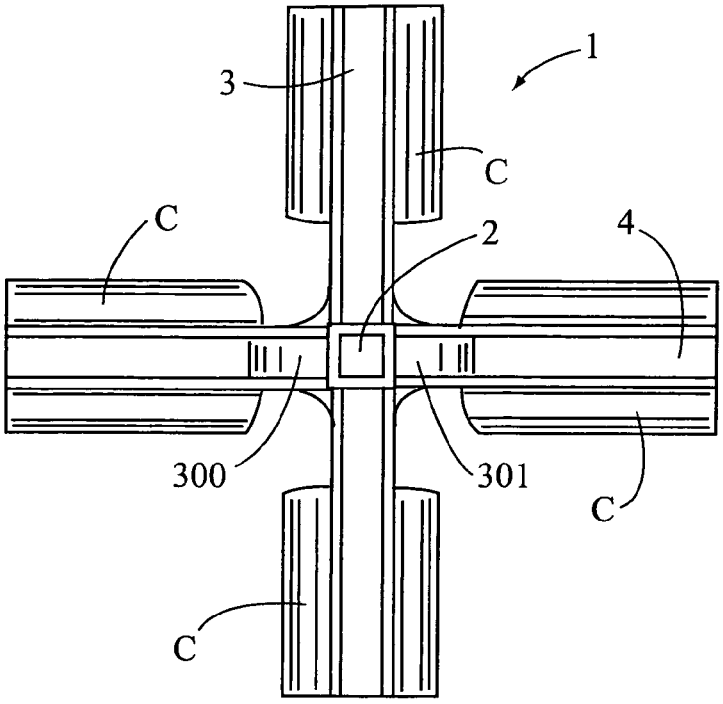
FIG. 21 is a top plan view of the FIG. 19 re-bar clip.
Figure 22:
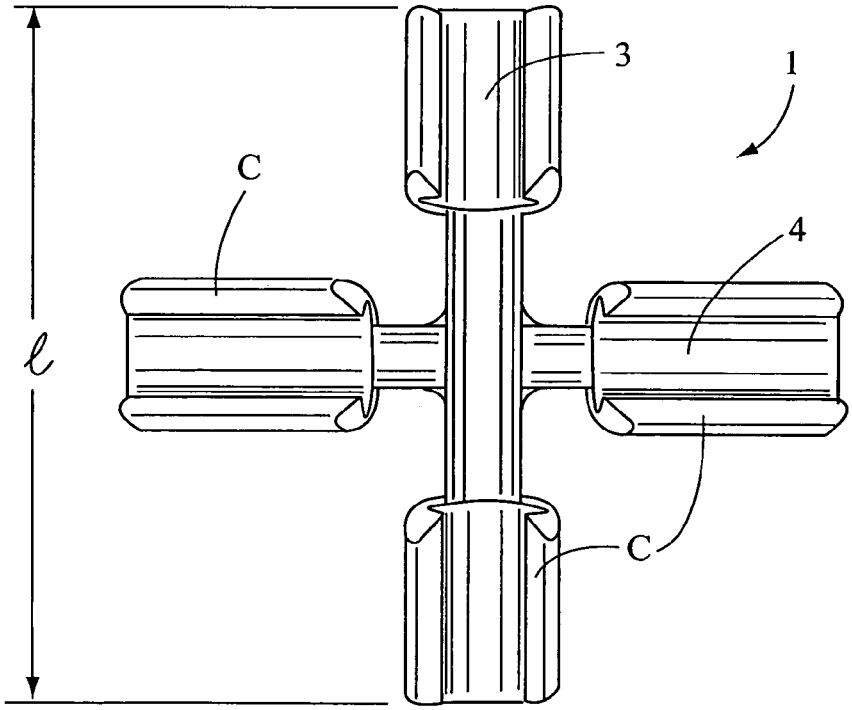
FIG. 22 is a bottom plan view of the FIG. 19 re-bar clip.
Figure 23:
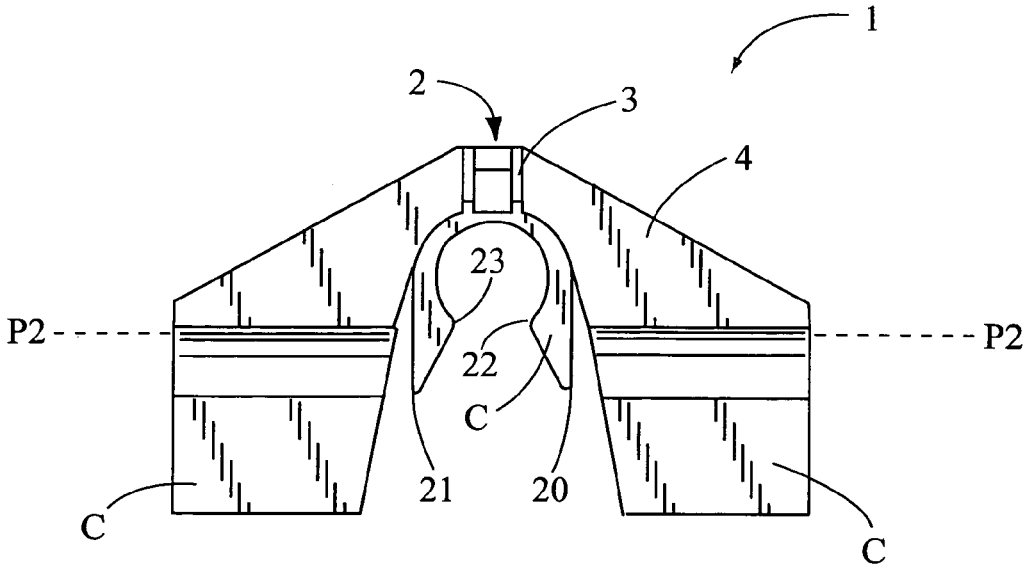
FIG. 23 is an adjacent side plan view of the re-bar clip of FIG. 20.

In FIG. 19, the length l of each arm is about 6.350 cm (2.5 inches). This may help provide a resistive force against deformation forces F1, F2. Clip 1 may help add to the temporary stability of the grid of joined re-bars.

Clip 1 may be placed on crossed re-bar as shown. A worker may then push in one direction D against the re-bars to engage all four clamps C. This may provide simple front side installation without necessarily requiring a worker's hand to reach behind the re-bars. However, if a situation so requires, clip 1, may be installed on the re-bar in an undersided motion.

Figure 24:
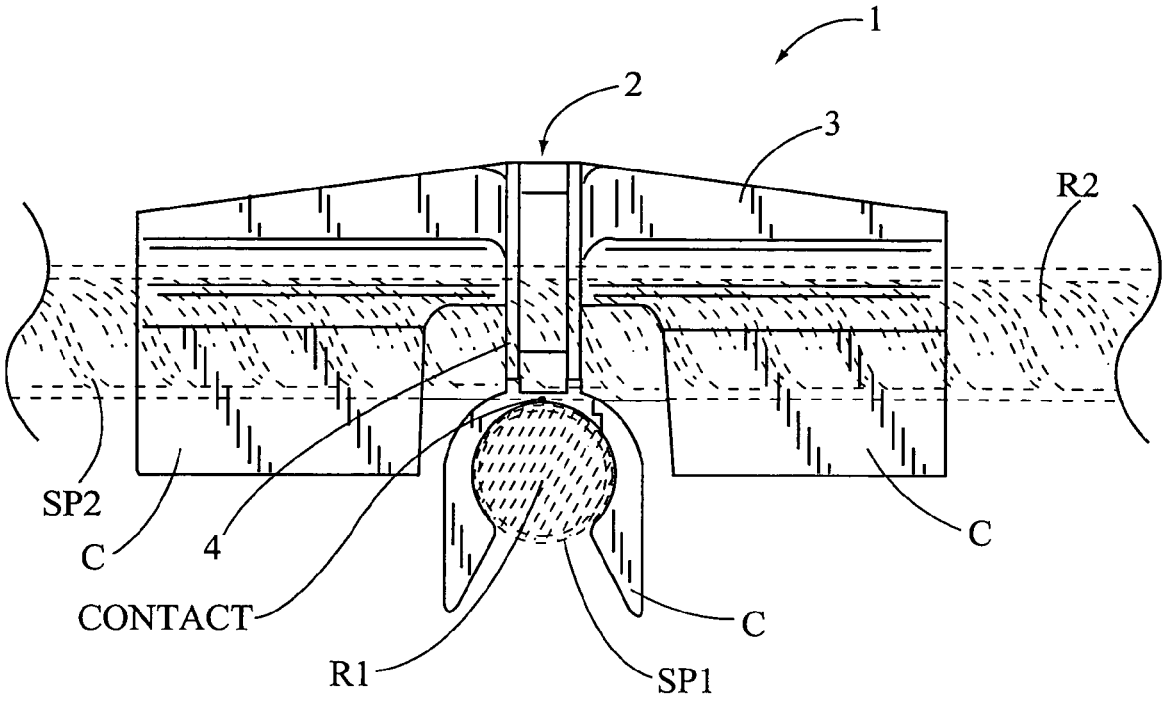
FIG. 24 is side plan view of the FIG. 19 re-bar clip illustrating connected re-bars in broken lines.
Figure 28:
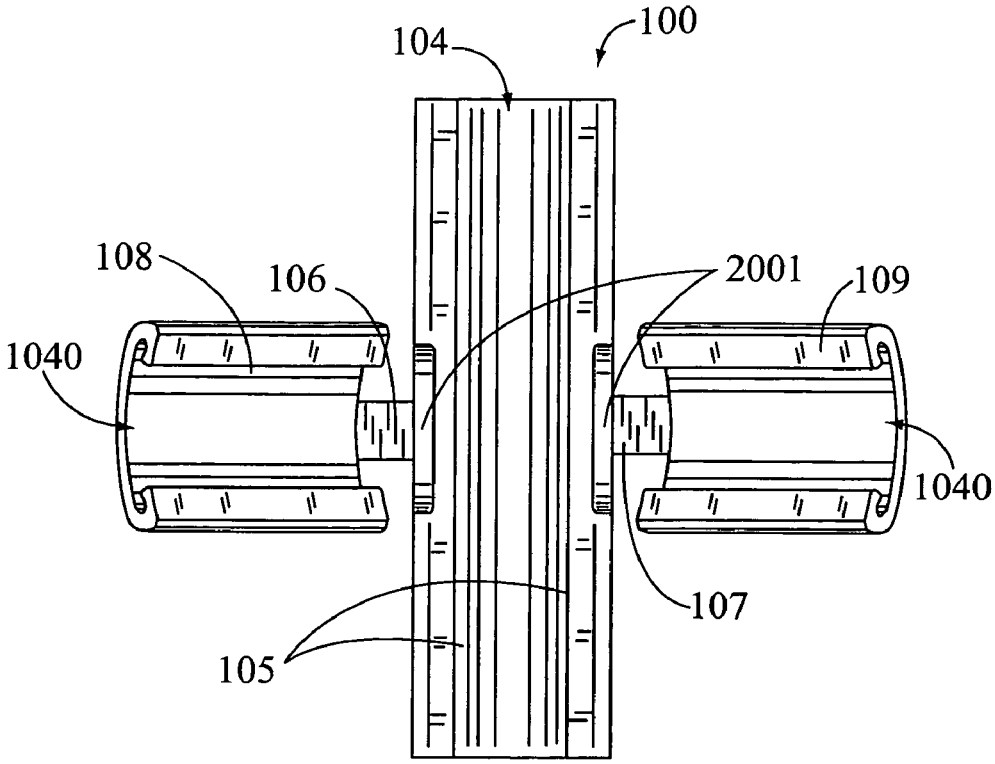
FIG. 28 is bottom plan view of the FIG. 25 re-bar clip.
Figure 29:
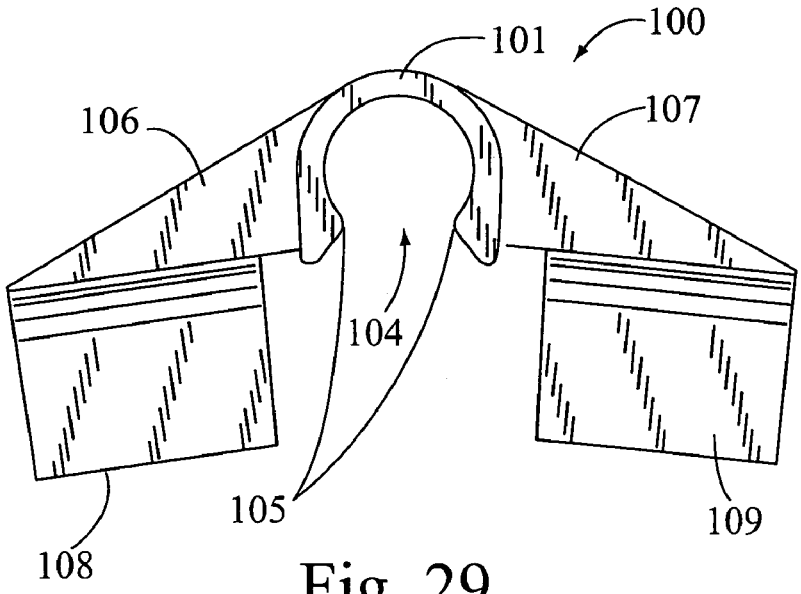
FIG. 29 is a side plan view of the FIG. 25 re-bar clip.

The extensions 300, 301 may help support arm 4 distal from center 2. Clamps C may be composed of equal halves, each half having a tip 20, 21 and an engagement flange 22, 23, wherein d1 is smaller than the width of a re-bar d2. Complete views are embodied of clip 1 with and without re-bars R1, R2. FIGS. 20-23 illustrate clip 1 without re-bar R1, R2. FIG. 24 illustrates clip 1 with re-bar R1 and R2.

Referring next to FIGS. 25-29 a clip 100 has a center 2000 from which emanates a semi-cylindrical tube 101 having a length of about 5.555 cm (2.187 inches) and a pair of arms 106, 107, having a length l of 6.668 cm (2.625 inches) wherein the tube 101 is set at about a 90° angle relative to the arms 106, 107. Arm 106 supports at clamp 108, and arm 107 supports a clamp 109. Clamps 108,109 may be identical. Clamps 108, 109 comprise openings that are extendable at least one re-bar width. Openings 1040 receive a re-bar which may contact a second re-bar received by opening 104 in the tube 101.

The physical dimensions of any clips disclosed herein, will depend on the size of the re-bar and the design specifications required. For example, if re-bar is being used on a corner, curb or other curved plan, an appropriately angled re-bar clip may be required whereas on a straight section of road, an approximately 90° angle clip may suffice. These clips are to be used with the anticipated stresses of the installation. The material the clips will be made of is also dependent on these factors.

When clip 100 is affixed to re-bars, the re-bars may physically contact one another at CONTACT. This contact may help reinforce the temporary stability of the crossed re-bar intersection before concrete is poured over the whole assembly. Engagement flanges 105 may help secure the re-bars. A cut-out 2001 in the tube 101 may be provided to help facilitate the contact of the re-bars.

Tube 101 and arms 106 and 107 may provide a resistive force against deformation forces F1, F2. Thus, clip 100 may help add to the temporary stability of the grid of joined re-bars.

Clip 100 may be placed on a crossed re-bar. A worker may then push in one direction D against center 2000 to engage tube 101 and clamps 108, 109. This may provide simple front side installation without necessarily requiring a worker's hand to reach behind the re-bars. Again, however, if a situation so requires, clip 100, may be installed on the re-bar in an undersided motion.

Clamps 108, 109 may be canted downward about 5-10° from the horizontal so as to allow arms 108, 109 to deform upward to a zero angle of horizontal deflection when the re-bar is connected into opening 104.

While a number of exemplifying features and embodiments have been discussed above, those of skill in the art will recognize certain modifications, permutations, additions and subcombinations thereof. No limitation with respect to the specific embodiments disclosed herein is intended or should be inferred.

I claim:

1. A concrete reinforcing bar clip comprising:

a pair of crossed arms oriented at an angle of $\phi_1$ relative to one another;

wherein a top body surface of a central body is formed by a juncture of said pair of crossed arms;

one of said pair of crossed arms having at least one clamp mounted adjacent to an end of said arm, said at least one clamp sized to mount onto a first concrete reinforcing bar;

said at least one clamp of said one of said pair of crossed arms having an opening, said clamp opening facing away from a top surface of the central body;

the other of said pair of crossed arms having at least one clamp mounted adjacent to an end of said arm, said at least one clamp sized to mount onto a second concrete reinforcing bar;

wherein said other of said pair of crossed arms supports said at least one clamp at a distance, allowing for at least one concrete reinforcing bar to pass adjacent therethrough;

said at least one clamp of said other of said pair of crossed arms having an opening, said clamp opening facing away from the top surface of the central body;

wherein a pair of crossing concrete reinforcing bars can be about simultaneously or consecutively joined by fixing said at least one clamp of said one of said pair of crossed arms and said at least one clamp of said other of said pair of crossed arms to crossing concrete reinforcing bars using a force against said top body surface of said central body; and wherein said top body surface of said central body has a convex shape with each arm of said pair of crossed arms curved to continue the convex surface to an outbound end of each arm, said clamps all ending at each outbound end of its respective arms.

2. The concrete reinforcing bar clip of claim 1, wherein said angle of $\phi_1$ is about 90°.

3. The concrete reinforcing bar clip of claim 1, wherein each clamp further comprises a construction of flexible polymer.

4. The concrete reinforcing bar clip of claim 1, wherein each clamp further comprises a pair of engagement flanges at each of its ends.

5. The concrete reinforcing bar clip of claim 1, wherein each clamp further comprises a pair of engagement flanges at each of its ends.

6. The concrete reinforcing bar clip of claim 1, wherein said central body has a concrete reinforcing bar support surface for said at least one clamp of said one of said pair of crossed arms.

7. The concrete reinforcing bar clip of claim 1, wherein said crossing concrete reinforcing bars make contact or almost make contact with each other.

* * * * *